US011238789B2

(12) United States Patent
Li

(10) Patent No.: US 11,238,789 B2
(45) Date of Patent: Feb. 1, 2022

(54) PIXEL CIRCUIT HAVING A DATA LINE FOR SENSING THRESHOLD AND MOBILITY CHARACTERISTICS OF THE CIRCUIT

(71) Applicant: BOE TECHNOLOGY GROUP CO., LTD., Beijing (CN)

(72) Inventor: Yongqian Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/911,371

(22) Filed: Jun. 24, 2020

(65) Prior Publication Data

US 2020/0410931 A1 Dec. 31, 2020

(30) Foreign Application Priority Data

Jun. 28, 2019 (CN) ..... 201910572723.1

(51) Int. Cl.
*G09G 3/3225* (2016.01)
*G09G 3/3233* (2016.01)

(52) U.S. Cl.
CPC ... *G09G 3/3225* (2013.01); *G09G 2300/0852* (2013.01); *G09G 2310/066* (2013.01)

(58) Field of Classification Search
CPC ..... G09G 3/32; G09G 3/3233
See application file for complete search history.

(56) References Cited

U.S. PATENT DOCUMENTS 8,558,825 B2 * 10/2013 Bae ..... G09G 3/3233 345/211
9,076,387 B1 * 7/2015 Lee ..... G09G 3/3258
(Continued)

FOREIGN PATENT DOCUMENTS

CN 104700773 A 6/2015
CN 105225631 A 1/2016
(Continued)

OTHER PUBLICATIONS

Office Action issued in corresponding Chinese Patent Application No. 201910572723.1, dated May 7, 2020.
(Continued)

*Primary Examiner* — Sepehr Azari
(74) *Attorney, Agent, or Firm* — McDermott Will & Emery LLP

(57) ABSTRACT

The present disclosure discloses a pixel driving circuit and a method of driving the same, a display panel and a display apparatus. The pixel driving circuit includes: a driving circuit, an energy storage circuit, a data and sensing line, a first initialization circuit, a second initialization circuit and a data writing circuit. The data and sensing line is configured to input a data signal or output a sensing signal; the first initialization circuit is configured to provide a potential at a voltage supply terminal to a control terminal of the driving circuit under control of a potential at a first control line; the second initialization circuit is configured to provide a potential at a second terminal of the driving circuit as the sensing signal to the data and sensing line under control of a potential at a second control line; and the data writing circuit is configured to provide the data signal input at the data and sensing line to the control terminal of the driving circuit under control of a potential at a third control line.

14 Claims, 6 Drawing Sheets

(56) References Cited

U.S. PATENT DOCUMENTS

| | | | | |
|---|---|---|---|---|
| 9,183,785 | B2 | 11/2015 | Kim | |
| 9,286,834 | B2 | 3/2016 | Yoon | |
| 9,548,020 | B2 * | 1/2017 | Kim | G09G 3/3233 |
| 9,558,717 | B2 | 1/2017 | Takasugi et al. | |
| 9,953,563 | B2 * | 4/2018 | Kishi | G09G 3/3241 |
| 10,262,588 | B2 | 4/2019 | Yoon et al. | |
| 10,373,555 | B2 | 8/2019 | Li et al. | |
| 10,529,278 | B2 * | 1/2020 | Wu | G09G 3/3275 |
| 10,665,165 | B2 | 5/2020 | Li et al. | |
| 10,769,992 | B2 | 9/2020 | Li et al. | |
| 2007/0195020 | A1 * | 8/2007 | Nathan | G09G 3/3233 345/76 |
| 2009/0051628 | A1 * | 2/2009 | Kwon | G09G 3/3233 345/77 |
| 2011/0210958 | A1 * | 9/2011 | Yoo | G09G 3/325 345/214 |
| 2013/0120228 | A1 | 5/2013 | Yoon | |
| 2015/0154913 | A1 | 6/2015 | Kim | |
| 2015/0379939 | A1 | 12/2015 | Takasugi et al. | |
| 2016/0012799 | A1 | 1/2016 | Kim | |
| 2017/0047017 | A1 * | 2/2017 | Shirouzu | G09G 3/3291 |
| 2017/0061877 | A1 * | 3/2017 | Lee | H01L 27/3262 |
| 2017/0193899 | A1 | 7/2017 | Yoon et al. | |
| 2017/0243539 | A1 | 8/2017 | Li et al. | |
| 2017/0249904 | A1 * | 8/2017 | Li | G09G 3/3233 |
| 2017/0309231 | A1 * | 10/2017 | Li | G09G 3/3225 |
| 2018/0240405 | A1 | 8/2018 | Li et al. | |

FOREIGN PATENT DOCUMENTS

| | | | |
|---|---|---|---|
| CN | 106652906 | A | 5/2017 |
| CN | 106652907 | A | 5/2017 |
| CN | 106935185 | A | 7/2017 |
| CN | 106935190 | A | 7/2017 |
| KR | 10-2013-0053660 | A | 5/2013 |

OTHER PUBLICATIONS

Office Action issued in corresponding Chinese Patent Application No. 201910572723.1, dated Mar. 12, 2021, with English translation.

* cited by examiner

PIXEL CIRCUIT HAVING A DATA LINE FOR SENSING THRESHOLD AND MOBILITY CHARACTERISTICS OF THE CIRCUIT

CROSS-REFERENCE TO RELATED APPLICATION(S)

This application claims priority to the Chinese Patent Application No. 201910572723.1, filed on Jun. 28, 2019, which is incorporated herein by reference in its entirety.

TECHNICAL FIELD

The present disclosure relates to the field of display technology, and more particularly, to a pixel driving circuit and a method of driving the same, a display panel and a display apparatus.

BACKGROUND

Generally, in an external compensation pixel circuit of an Organic Light Emitting Diode (OLED), a data line and a sensing line are two separate control lines, but since there is a large number of channels of a source driving chip, it is not conducive to improving a physical resolution of a panel, and limits a speed at which compensation is performed.

SUMMARY

The present disclosure provides a pixel driving circuit and a method of driving the same, a display panel and a display apparatus.

According to a first aspect of the embodiments of the present disclosure, there is provided a pixel driving circuit, comprising: a driving circuit having a control terminal, a first terminal coupled to a first power supply and a second terminal coupled to a light emitting element, and configured to generate a driving current for driving the light emitting element under control of a potential at the control terminal of the driving circuit; an energy storage circuit having a first terminal coupled to the control terminal of the driving circuit, and a second terminal coupled to the second terminal of the driving circuit; a data and sensing line configured to input a data signal or output a sensing signal; a first initialization circuit coupled to a voltage supply terminal, the control terminal of the driving circuit and a first control line, and configured to provide a potential at the voltage supply terminal to the control terminal of the driving circuit under control of a potential at the first control line; a second initialization circuit coupled to the data and sensing line, the second terminal of the driving circuit and a second control line, and configured to provide a potential at the second terminal of the driving circuit as the sensing signal to the data and sensing line under control of a potential at the second control line; and a data writing circuit coupled to the data and sensing line, the control terminal of the driving circuit and a third control line, and configured to provide a data signal input at the data and sensing line to the control terminal of the driving circuit under control of a potential at the third control line.

According to an embodiment of the present disclosure, the first initialization circuit comprises: a first transistor having a first electrode coupled to the voltage supply terminal, a second electrode coupled to the control terminal of the driving circuit, and a control electrode coupled to the first control line.

According to an embodiment of the present disclosure, the second initialization circuit comprises: a second transistor having a first electrode coupled to the data and sensing line, a second electrode coupled to the second terminal of the driving circuit, and a control electrode coupled to the second control line.

According to an embodiment of the present disclosure, the data writing circuit comprises: a third transistor having a first electrode coupled to the data and sensing line, a second electrode coupled to the control terminal of the driving circuit, and a control electrode coupled to the third control line.

According to an embodiment of the present disclosure, the driving circuit comprises a driving transistor having a first electrode coupled to the first power supply to act as the first terminal of the driving circuit, a second electrode coupled to the light emitting element to act as the second terminal of the driving circuit, and a control electrode coupled to the energy storage circuit, the first initialization circuit and the data writing circuit to act as the control terminal of the driving circuit; and the energy storage circuit comprises a first capacitor having a first electrode coupled to the control electrode of the driving transistor to act as the first terminal of the energy storage circuit, and a second electrode coupled to the second electrode of the driving transistor to act as the second terminal of the energy storage circuit.

According to an embodiment of the present disclosure, the pixel driving circuit further comprises a second capacitor having a first electrode coupled to the data and sensing line, and a second electrode coupled to a second power supply.

According to a second aspect of the embodiments of the present disclosure, there is provided a method of driving a pixel driving circuit, the pixel driving circuit comprising: a driving circuit having a control terminal, a first terminal coupled to a first power supply and a second terminal coupled to a light emitting element, and configured to generate a driving current for driving the light emitting element under control of a potential at the control terminal of the driving circuit; an energy storage circuit having a first terminal coupled to the control terminal of the driving circuit, and a second terminal coupled to the second terminal of the driving circuit; a data and sensing line configured to input a data signal or output a sensing signal; a first initialization circuit coupled to a voltage supply terminal, the control terminal of the driving circuit and a first control line, and configured to provide a potential at the voltage supply terminal to the control terminal of the driving circuit under control of a potential at the first control line; a second initialization circuit coupled to the data and sensing line, the second terminal of the driving circuit and a second control line, and configured to provide a potential at the second terminal of the driving circuit as the sensing signal to the data and sensing line under control of a potential at the second control line; and a data writing circuit coupled to the data and sensing line, the control terminal of the driving circuit and a third control line, and configured to provide a data signal input at the data and sensing line to the control terminal of the driving circuit under control of a potential at the third control line; and the driving method comprising: in a display mode, writing, by the data writing circuit, the data signal input at the data and sensing line into the control terminal of the driving circuit under control of the potential at the first control line, and generating, by the driving circuit, the driving current for driving the light emitting element under control of the potential at the control terminal of the driving circuit; and in a sensing mode, providing, by the second initialization circuit, the potential at the second terminal of the driving circuit to the data and sensing line to be output as the sensing signal under control of the potential at the second control line.

According to an embodiment of the present disclosure, in the sensing mode, during a sensing initialization phase, inputting, by the first initialization circuit, a reference voltage provided at the voltage supply terminal to the control terminal of the driving circuit under control of the potential at the first control line; and during a data output phase, generating, by the driving circuit, a sensing voltage at the second terminal of the driving circuit under control of the reference voltage and the first power supply, and providing, by the second initialization circuit, the sensing voltage generated at the second terminal of the driving circuit to the data and sensing line to be output as the sensing signal under control of the potential at the second control line.

According to an embodiment of the present disclosure, in the display mode, during a display initialization phase, providing, by the first initialization circuit, a first initialization voltage provided at the voltage supply terminal to the control terminal of the driving circuit under control of the potential at the first control line to initialize the control terminal of the driving circuit, and providing, by the second initialization circuit, a second initialization voltage provided at the data and sensing line to the second terminal of the driving circuit under control of the potential at the second control line to initialize the second terminal of the driving circuit; during a data writing phase, writing, by the data writing circuit, the data signal input at the data and sensing line into the control terminal of the driving circuit under control of the potential at the first control line; and during a light emitting phase, driving, by the driving circuit, the light emitting element to emit light under control of the data signal.

According to an embodiment of the present disclosure, the sensing mode comprises a first sensing mode and a second sensing mode, wherein an operation in the first sensing mode is performed during a blanking period of a display cycle of one frame of screen; and an operation in the second sensing mode is performed during a period in which display of the screen is disabled.

According to an embodiment of the present disclosure, in the second sensing mode, during the data output phase, continuously inputting, by the first initialization circuit, the reference voltage provided at the voltage supply terminal to the control terminal of the driving circuit under control of the potential at the first control line.

According to an embodiment of the present disclosure, in the first sensing mode, during the data output phase, stopping, by the first initialization circuit, inputting the reference voltage provided at the voltage supply terminal to the control terminal of the driving circuit under control of the potential at the first control line.

According to a third aspect of the embodiments of the present disclosure, there is provided a display panel comprising the pixel driving circuit according to the first aspect of the present disclosure.

According to an embodiment of the present disclosure, the display panel further comprises a data driving circuit coupled to the data and sensing line of the pixel driving circuit, and configured to acquire the sensing signal output by the data and sensing line, compensate for the data signal based on the sensing signal, and provide a compensated data signal to the data and sensing line.

According to a fourth aspect of the embodiments of the present disclosure, there is provided a display apparatus comprising the display panel according to the third aspect of the present disclosure.

BRIEF DESCRIPTION OF THE ACCOMPANYING DRAWINGS

DETAILED DESCRIPTION

Hereinafter, embodiments of the present disclosure will be described in detail. Examples of the embodiments are shown in the accompanying drawings, in which the same or similar reference signs indicate the same or similar elements or elements having the same or similar functions. The embodiments described below with reference to the accompanying drawings are exemplary, and are intended to explain the present disclosure, but should not be construed as limiting the present disclosure.

Transistors used in the embodiments of the present disclosure may all be thin film transistors, field effect transistors, or other devices having the same characteristics. According to a function in the circuit, the transistors used in the embodiments of the present disclosure are mainly switching transistors. Since a source and a drain of the thin film transistor used here are symmetrical, the source and the drain may be interchanged. In the embodiments of the present disclosure, one of the source and the drain is called a first electrode, and the other of the source and the drain is called a second electrode. In the following examples, description is made by taking a case where the driving transistors are N-type thin film transistors as an example, and other transistors have the same type as that of the driving transistors or have different types from that of the driving transistors according to circuit design.

Figure 1:
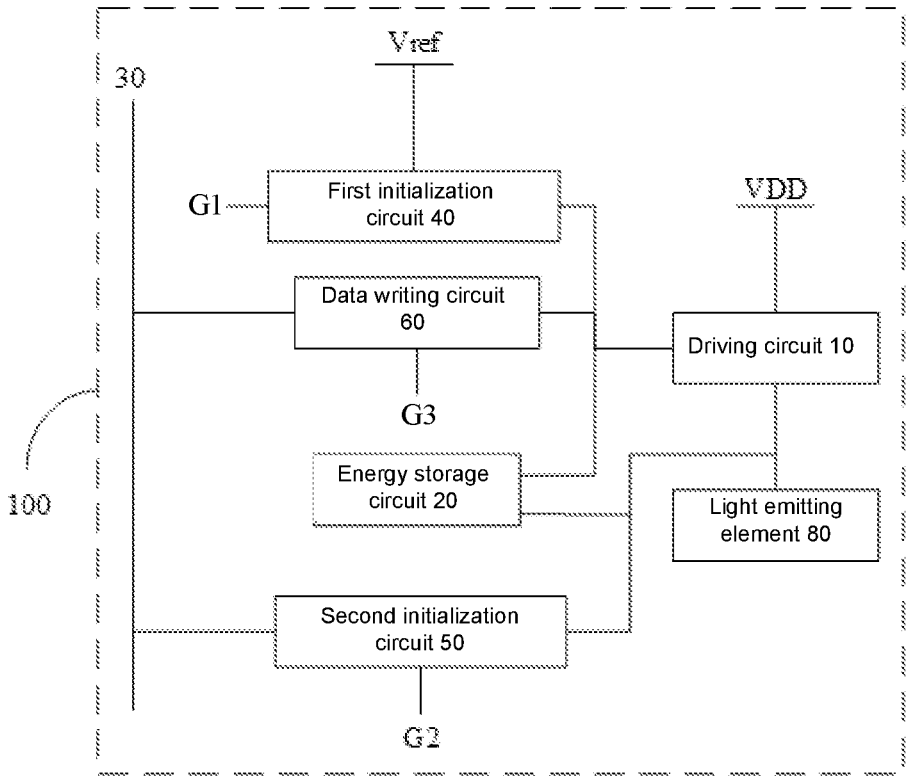
FIG. 1 is a schematic block diagram of a pixel driving circuit according to an embodiment of the present disclosure.

The pixel driving circuit and the method of driving the same, the display panel and the display apparatus according to the embodiments of the present disclosure will be described below with reference to the accompanying drawings. FIG. 1 is a schematic block diagram of a pixel driving circuit according to an embodiment of the present disclosure. As shown in FIG. 1, the pixel driving circuit 100 according to the embodiment of the present disclosure comprises a driving circuit 10, an energy storage circuit 20, a data and sensing line 30, a first initialization circuit 40, a second initialization circuit 50 and a data writing circuit 60.

The driving circuit 10 has a control terminal, a first terminal, and a second terminal. The first terminal of the driving circuit 10 is coupled to a first power supply VDD, and the second terminal of the driving circuit 10 is coupled to a light emitting element 80. The energy storage circuit 20 has a first terminal coupled to the control terminal of the driving circuit 10, and a second terminal coupled to the second terminal of the driving circuit 10. The first initialization circuit 40 is coupled to a voltage supply terminal Vref, the control terminal of the driving circuit 10, and a first control line G1. The second initialization circuit 50 is coupled to the data and sensing line 30, the second terminal of the driving circuit 10, and a second control line G2. The data writing circuit 60 is coupled to the data and sensing line 30, the control terminal of the driving circuit 10, and a third control line G3.

The driving circuit 10 may generate a driving current for driving the light emitting element 80 under control of a potential at the control terminal of the driving circuit 10. The first initialization circuit 40 may provide a potential at the voltage supply terminal Vref to the control terminal of the driving circuit 10 under control of a potential at the first control line G1. The second initialization circuit 50 may provide a potential at the second terminal of the driving circuit 10 as a sensing signal to the data and sensing line 30 under control of a potential at the second control line G2. The data writing circuit 60 may provide a data signal input at the data and sensing line 30 to the control terminal of the driving circuit 10 under control of a potential at the third control line G3.

According to an embodiment of the present disclosure, the data and sensing line 30 may be used to input the data signal or output the sensing signal. For example, in a display mode, the data and sensing line 30 writes the data signal into the control terminal of the driving circuit 10 through the data writing circuit 60, and in a sensing mode, the data and sensing line 30 receives the sensing signal output by the driving circuit 10 through the second initialization circuit 50 to acquire an external compensation value for the driving circuit 10.

In the sensing mode, the data and sensing line 30 may provide the sensing signal to a data driving circuit. The data driving circuit acquires the external compensation value for the driving circuit 10 according to the received sensing signal output by the driving circuit 10 through the second initialization circuit 50. Then in the display mode, the data driving circuit may convert input image data into external compensation image data using the external compensation value, and may write a data voltage corresponding to the external compensation image data as a data signal into the control terminal of the driving circuit 10 through the data writing circuit 60 via the data and sensing line 30.

Thereby, the data line and the sensing line are combined into one data and sensing line 30, so that a number of channels of the data driving circuit chip may be reduced while ensuring the accuracy of the acquired external compensation value, which is beneficial to improve the physical resolution of the panel while improving the speed at which compensation is performed.

Specifically, according to an embodiment of the present disclosure, in the sensing mode, the driving circuit 10 outputs the sensing signal through the second initialization circuit 50 under control of a reference voltage, wherein the reference voltage is provided by the voltage supply terminal Vref to the driving circuit 10 through the first initialization circuit 40. According to an embodiment, the reference voltage may be a high-level voltage.

According to an embodiment of the present disclosure, the sensing mode comprises a first sensing mode and a second sensing mode. The first sensing mode is used for sensing mobility, and the second sensing mode is used for sensing a driving threshold. When a screen is displayed, sensing is performed on the mobility during a blanking period of a display cycle of one frame of screen. When the screen is not displayed, that is, during a period in which the display of the screen is disabled, sensing is performed on the driving threshold.

The blanking period is an idle display period after a display screen has been formed during the display cycle of one frame of screen. In addition, since the sensing of the driving threshold lasts for a relatively long time, sensing may be performed on the driving threshold when the screen is not displayed, that is, when the power is turned off and the screen is black.

Figure 2:
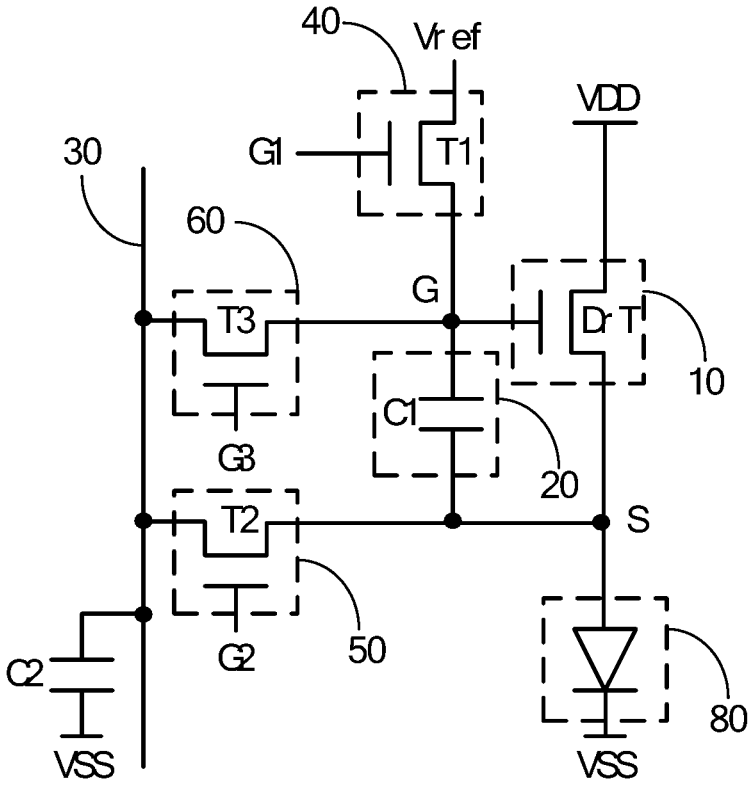
FIG. 2 is a schematic circuit diagram of a pixel driving circuit according to an embodiment of the present disclosure.

FIG. 2 is a schematic circuit diagram of a pixel driving circuit according to an embodiment of the present disclosure. As shown in FIG. 2, the first initialization circuit 40 comprises a first transistor T1 having a first electrode coupled to the voltage supply terminal Vref, a second electrode coupled to the control terminal of the driving circuit 10, and a control electrode coupled to the first control line G1.

As shown in FIG. 2, the second initialization circuit 50 comprises a second transistor T2 having a first electrode coupled to the data and sensing line 30, a second electrode coupled to the second electrode of the driving circuit 10, and a control electrode coupled to the second control line G2.

As shown in FIG. 2, the data writing circuit 60 comprises a third transistor T3 having a first electrode coupled to the data and sensing line 30, a second electrode coupled to the control terminal of the driving circuit 10, and a control electrode coupled to the third control line G3.

As shown in FIG. 2, the driving circuit 10 comprises a driving transistor DrT. The driving transistor DrT has a first electrode coupled to the first power supply VDD to act as the first terminal of the driving circuit, a second electrode coupled to the light emitting element 80 to act as the second terminal of the driving circuit, and a control electrode coupled to the energy storage circuit 20, the first initialization circuit 40 and the data writing circuit 60 to act as the control terminal of the driving circuit. The energy storage circuit 20 comprises a first capacitor C1 having a first electrode coupled to the control electrode of the driving transistor DrT to act as the first terminal of the energy storage circuit 20, and a second electrode coupled to the second electrode of the driving transistor DrT to act as the second terminal of the energy storage circuit 20.

As shown in FIG. 2, the pixel driving circuit according to the embodiment further comprises a second capacitor C2 having a first electrode coupled to the data and sensing line 30, and a second electrode coupled to a second power supply VSS.

Figure 3:
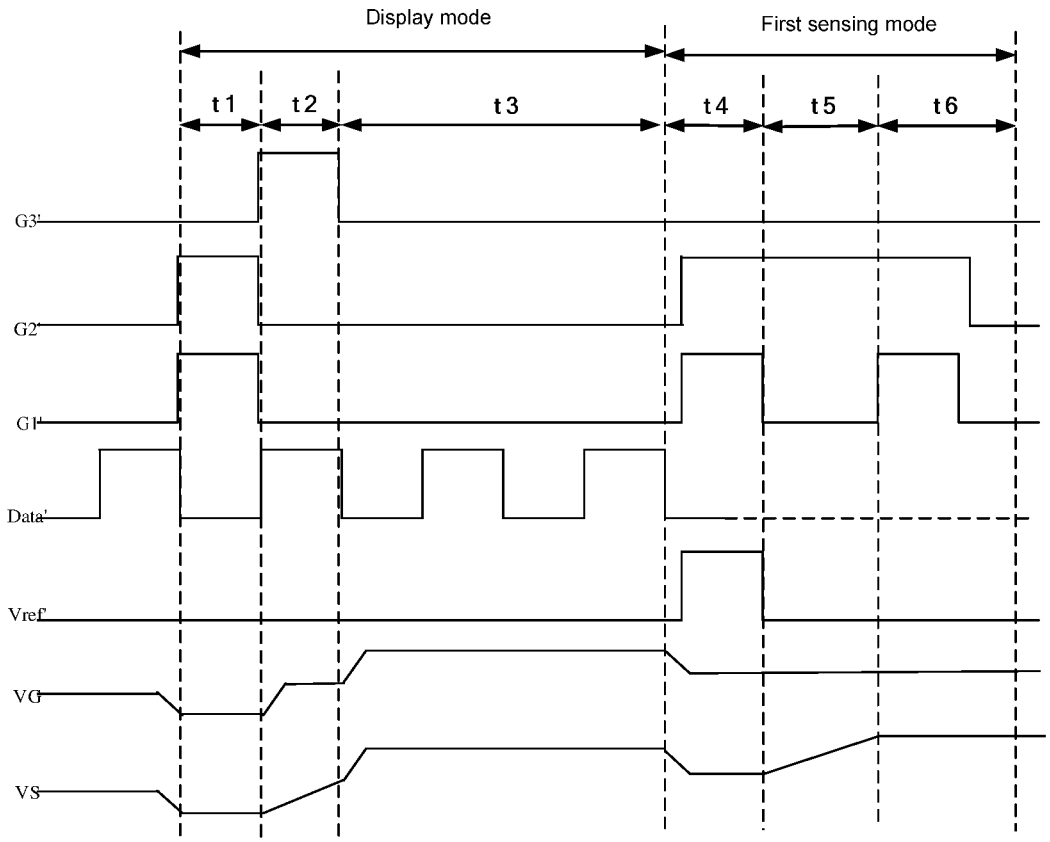
FIG. 3 is a timing diagram of a pixel driving circuit according to an embodiment of the present disclosure.
Figure 4:
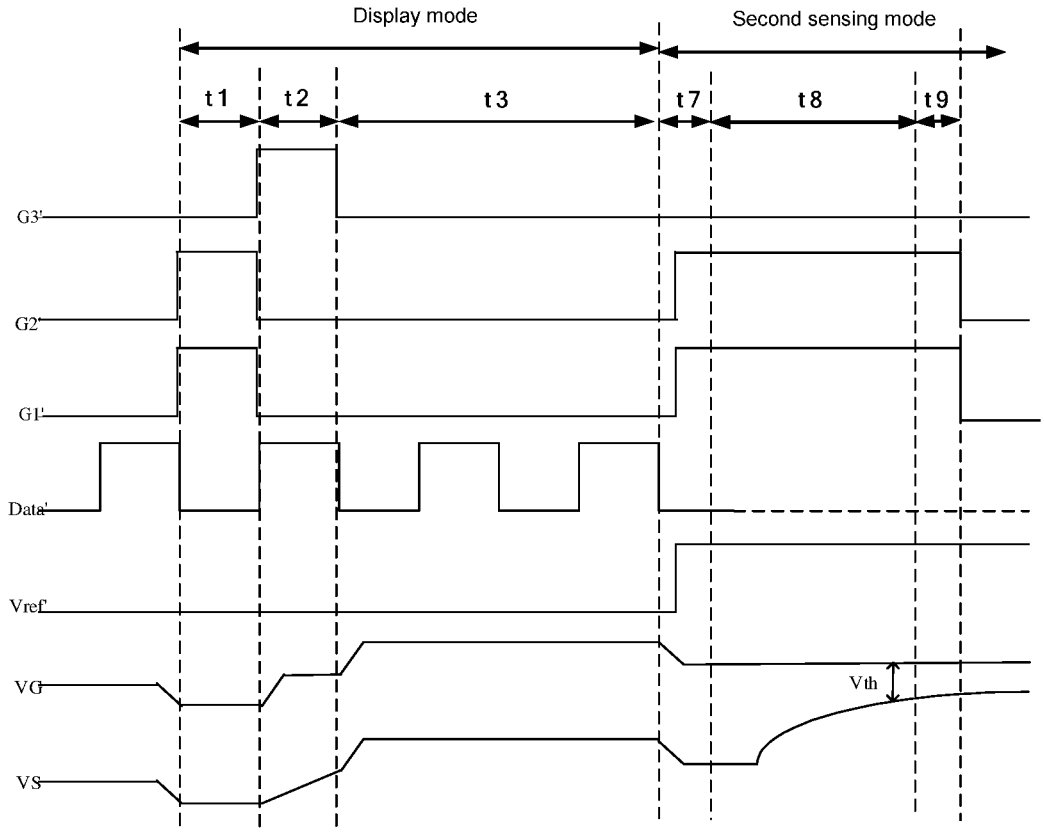
FIG. 4 is a timing diagram of a pixel driving circuit according to another embodiment of the present disclosure.

FIGS. 3 and 4 are timing diagrams of a pixel driving circuit according to an embodiment of the present disclosure. A working principle of the pixel driving circuit according to the embodiment of FIG. 2 will be described below with reference to the timing diagrams of FIGS. 3 and 4.

FIG. 3 illustrates a timing in the display mode and the first sensing mode (for sensing mobility), in which G1' is an input signal at the first control line G1, G2' is an input signal at the second control line G2, G3' is an input signal at the third control line G3, Data' is an input signal at the data and sensing line 30, Vref' is a voltage signal provided at the voltage supply terminal Vref, VG is a potential at the control electrode of the driving transistor DrT, and VS is a potential at the second electrode of the driving transistor DrT.

As shown in FIG. 3, during a display initialization phase t1 in the display mode, the input signal at the third control line G3 is at a low level, and the third transistor T3 is turned off. The input signal at the first control line G1 is a first turn-on signal, i.e., a high-level signal, and the first transistor T1 is turned on under control of the first turn-on signal, and provides the first initialization voltage provided at the voltage supply terminal Vref, i.e., a low-level voltage, to the control electrode of the driving transistor DrT (point G in FIG. 2) to initialize the control electrode of the driving transistor DrT. That is, at this time, a potential at the point G is a low-level potential. The input signal at the second control line G2 is a second turn-on signal, i.e., a high-level signal, and the second transistor T2 is turned on under control of the second turn-on signal, and provides the second initialization voltage provided at the data and sensing line 30, i.e., a low-level voltage, to the second electrode of the driving transistor DrT (point S in FIG. 2) to initialize the second electrode of the driving transistor DrT. That is, at this time, a potential at the point S is a low-level potential.

During a data writing phase t2 in the display mode, the input signal at the second control line G2 is a second turn-off signal, i.e., a low-level signal, and the second transistor T2 is turned off under control of the second turn-off signal. The input signal at the first control line G1 is a first turn-off signal, i.e., a low-level signal, and the first transistor T1 is turned off under control of the first turn-off signal. The input signal at the third control line G3 is a third turn-on signal, i.e., a high-level signal, and the third transistor T3 is turned on under control of the third turn-on signal. The data signal provided by the data and sensing line 30, i.e., a high-level voltage, is written into the control electrode of the driving transistor DrT through the third transistor T3. Specifically, the data signal is written into the point G and is held by the first capacitor C1, and the driving transistor DrT is turned on under control of a voltage of the data signal.

During a light emitting phase t3 in the display mode, the input signal at the first control line G1 is the first turn-off signal, i.e., a low-level signal, the input signal at the second control line G2 is the second turn-off signal, i.e., a low-level signal, and the input signal at the third control line G3 is the third turn-off signal, i.e., a low-level signal, and the first transistor T1, the second transistor T2, and the third transistor T3 are all turned off. At this time, the voltage at the point G, i.e., the voltage at the control electrode of the driving transistor DrT, continues to cause the driving transistor DrT to be turned on, and the potential at the second electrode of the driving transistor DrT, i.e., the point S, continues to rise. Since the point G is in a floating state, the potential VG at the point G rises as the potential VS at the point S rises under a bootstrap effect of the first capacitor C1. The voltage of the first power supply VDD causes the driving transistor DrT to generate driving current. The generated driving current flows from an anode of the light emitting element 80 to a cathode of the light emitting element 80 to drive the light emitting element 80 to emit light.

During a sensing initialization phase t4 for sensing the mobility, the input signal at the first control line G1 is the first turn-on signal, i.e., a high-level signal, and the first transistor T1 is turned on under control of the first turn-on signal, and writes the reference voltage provided at the voltage supply terminal Vref, i.e., a high-level voltage, into the control electrode of the driving transistor DrT. Specifically, the reference voltage is written into the point G and is held by the first capacitor C1.

During a data output phase t5 for sensing the mobility, the input signal at the first control line G1 becomes the first turn-off signal, i.e., a low-level signal, and the first transistor T1 is turned off. The voltage at the control electrode of the driving transistor DrT, i.e., the point G, still remains at the reference voltage, i.e., a high-level voltage, through the first capacitor C1, and the driving transistor DrT is turned on. The voltage of the first power supply VDD, i.e., a high-level voltage, is applied to the second electrode of the driving transistor DrT, i.e., the point S, through the driving transistor DrT, and the potential at the second electrode of the driving transistor DrT, i.e., the point S, rises under action of the first power supply VDD. At this time, since the input signal at the second control line G2 is the second turn-on signal, i.e., a high-level signal, the second transistor T2 is turned on, and the potential at the second electrode of the driving transistor DrT, i.e., the point S, is provided to the data and sensing line 30 through the second transistor T2, so that the external compensation value for the driving circuit 10 may be acquired according to the potential provided to the data and sensing line 30.

During a sensing phase t6 for sensing the mobility, the input signal at the first control line G1 is the first turn-on signal, i.e., a high-level signal, and the first transistor T1 is turned on under control of the first turn-on signal, and writes a low-level voltage provided at the voltage supply terminal Vref into the control electrode of the driving transistor DrT. Specifically, the low-level signal is written into the point G, and the driving transistor DrT is turned off. The input signal at the second control line G2 is the second turn-on signal, i.e., a high-level signal, and the second transistor T2 is turned on, and the data driving circuit may acquire a voltage of the sensing signal which is provided to the data and sensing line 30 and is used to generate the external compensation value.

FIG. 4 illustrates a timing in the display mode and the second sensing mode (for sensing a driving threshold).

As shown in FIG. 4, during a display initialization phase t1 in the display mode, the input signal at the third control line G3 is at a low level, and the third transistor T3 is turned off. The input signal at the first control line G1 is a first turn-on signal, i.e., a high-level signal, and the first transistor T1 is turned on under control of the first turn-on signal, and provides the first initialization voltage provided at the voltage supply terminal Vref, i.e., a low-level voltage, to the control electrode of the driving transistor DrT (point G in FIG. 2) to initialize the control electrode of the driving transistor DrT. That is, at this time, a potential at the point G is a low-level potential. The input signal at the second control line G2 is a second turn-on signal, i.e., a high-level signal, and the second transistor T2 is turned on under control of the second turn-on signal, and provides the second initialization voltage provided at the data and sensing line 30, i.e., a low-level voltage, to the second electrode of the driving transistor DrT (point S in FIG. 2) to initialize the second electrode of the driving transistor DrT. That is, at this time, a potential at the point S is a low-level potential.

During a data writing phase t2 in the display mode, the input signal at the second control line G2 is a second turn-off signal, i.e., a low-level signal, and the second transistor T2 is turned off under control of the second turn-off signal. The input signal at the first control line G1 is a first turn-off signal, i.e., a low-level signal, and the first transistor T1 is turned off under control of the first turn-off signal. The input signal at the third control line G3 is a third turn-on signal, i.e., a high-level signal, and the third transistor T3 is turned on under control of the third turn-on signal. The data signal provided by the data and sensing line 30, i.e., a high-level voltage, is written into the control electrode of the driving transistor DrT through the third transistor T3. Specifically, the data signal is written into the point G and is held by the first capacitor C1, and the driving transistor DrT is turned on under control of a voltage of the data signal.

During a light emitting phase t3 in the display mode, the input signal at the first control line G1 is the first turn-off signal, i.e., a low-level signal, the input signal at the second control line G2 is the second turn-off signal, i.e., a low-level signal, and the input signal at the third control line G3 is the third turn-off signal, i.e., a low-level signal, and the first transistor T1, the second transistor T2, and the third transistor T3 are all turned off. At this time, the voltage at the point G, i.e., the voltage at the control electrode of the driving transistor DrT, continues to cause the driving transistor DrT to be turned on, and the potential at the second electrode of the driving transistor DrT, i.e., the point S, continues to rise. Since the point G is in a floating state, the potential VG at the point G rises as the potential VS at the point S rises under a bootstrap effect of the first capacitor C1. The voltage of the first power supply VDD causes the driving transistor DrT to generate a driving current. The generated driving current flows from an anode of the light emitting element 80 to a cathode of the light emitting element 80 to drive the light emitting element 80 to emit light.

During a sensing initialization phase t7 for sensing the driving threshold, the input signal at the first control line G1 is the first turn-on signal, i.e., a high-level signal, and the first transistor T1 is turned on under control of the first turn-on signal, and writes the reference voltage provided at the voltage supply terminal Vref, i.e., a high-level voltage, into the control electrode of the driving transistor DrT. Specifically, the reference voltage is written into the point G and is held by the first capacitor C1.

During a data output phase t8 for sensing the driving threshold, the input signal at the first control line G1 is the first turn-on signal, i.e., a high-level signal, and the first transistor T1 is turned on. The first transistor T1 continues to write the reference voltage provided at the voltage supply terminal Vref, i.e., a high-level signal, into the control electrode of the driving transistor DrT, and the driving transistor DrT remains to be turned on. The voltage of the first power supply VDD, i.e., a high-level voltage, is applied to the second electrode of the driving transistor DrT, i.e., the point S, through the driving transistor DrT, to cause the potential at the second electrode of the driving transistor DrT, i.e., the point S, to gradually rise. The potential at the point S stops rising when it reaches Vref'-Vth. Here, Vref' is the reference voltage provided at the voltage supply terminal Vref, and Vth is the threshold voltage of the driving transistor DrT. Since the input signal at the second control line G2 is the second turn-on signal, i.e., a high-level signal, and the second transistor T2 is turned on, the potential at the second electrode of the driving transistor DrT, i.e., the point S, is provided to the data and sensing line 30 through the second transistor T2. That is, the data and sensing line 30 is charged to Vref'-Vth under control of the reference voltage Vref' provided at the voltage supply terminal Vref, so that the external compensation value for the driving circuit 10 may be acquired according to the potential provided to the data and sensing line 30.

During a sensing phase t9 for sensing the driving threshold, the input signal at the first control line G1 is the first turn-on signal, i.e., a high-level signal, and the first transistor T1 continues to be turned on. The input signal at the second control line G2 is the second turn-on signal, i.e., a high-level signal, and the second transistor T2 continues to be turned on, and at this time, the data driving circuit may acquire a voltage of the sensing signal which is provided to the data and sensing line 30 and is used to generate the external compensation value.

Thereby, the data line and the sensing line are combined, so that a driving waveform in the display mode and a driving waveform in the sensing mode may be combined while realizing functions of compensating for the mobility when the screen is displayed and compensating for the driving threshold when the screen is not displayed.

In summary, with the pixel driving circuit according to the embodiments of the present disclosure, the data line and the sensing line are combined, so that a number of channels of the data driving circuit chip may be reduced while ensuring the accuracy of the acquired external compensation value, which is beneficial to improve the physical resolution of the panel while improving the speed at which compensation is performed. In addition, the pixel driving circuit according to the embodiments of the present disclosure also has advantages of simple driving waveforms and easy gate driving integration.

The embodiments of the present disclosure further provide a method of driving a pixel driving circuit, which is used to drive the pixel driving circuit according to the embodiments described above.

Figure 5:
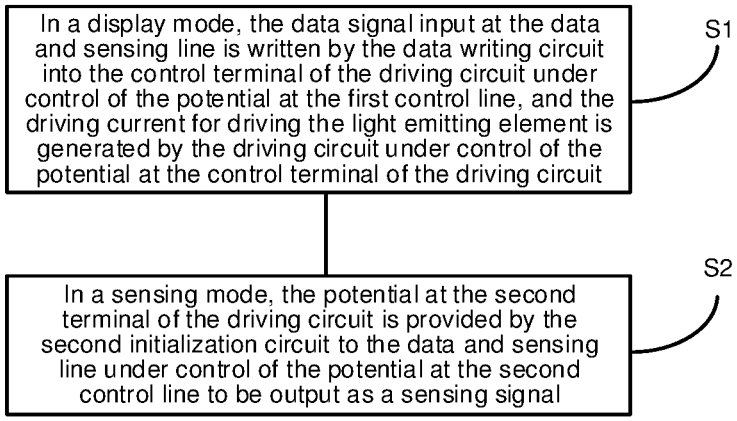
FIG. 5 is a schematic flowchart of a method of driving a pixel driving circuit according to an embodiment of the present disclosure.

FIG. 5 is a schematic flowchart of a method of driving a pixel driving circuit according to an embodiment of the present disclosure. As shown in FIG. 5, the method 500 of driving a pixel driving circuit according to the embodiment of the present disclosure comprises the following steps.

In step S1, in a display mode, the data signal input at the data and sensing line is written by the data writing circuit into the control terminal of the driving circuit under control of the potential at the first control line, and the driving current for driving the light emitting element is generated by the driving circuit under control of the potential at the control terminal of the driving circuit.

In step S2, in a sensing mode, the potential at the second terminal of the driving circuit is provided by the second initialization circuit to the data and sensing line under control of the potential at the second control line to be output as a sensing signal.

According to an embodiment of the present disclosure, the sensing mode comprises a first sensing mode and a second sensing mode, wherein the first sensing mode is used for sensing mobility, and the second sensing mode is used for sensing a driving threshold. When a screen is displayed, sensing is performed on the mobility during a blanking period of a display cycle of one frame of screen. When the screen is not displayed, that is, during a period in which the display of the screen is disabled, sensing is performed on the driving threshold.

According to an embodiment of the present disclosure, the method of driving a pixel driving circuit further comprises: during a sensing initialization phase in the sensing mode, a reference voltage provided at the voltage supply terminal is input by the first initialization circuit into the control terminal of the driving circuit under control of a first turn-on signal at the first control line, and during a data output phase in the sensing mode, a sensing voltage is generated by the driving circuit at the second terminal of the driving circuit under control of the reference voltage and the first power supply, and the sensing voltage generated at the second terminal of the driving circuit is provided by the second initialization circuit to the data and sensing line under control of the potential at the second control line to be output as a sensing signal.

According to an embodiment of the present disclosure, during a display initialization phase in the display mode, a first initialization voltage provided at the voltage supply terminal is provided by the first initialization circuit to the control terminal of the driving circuit under control of the first turn-on signal at the first control line to initialize the control terminal of the driving circuit, and a second initialization voltage provided at the data and sensing line is provided by the second initialization circuit to the second terminal of the driving circuit under control of a second turn-on signal at the second control line to initialize the second terminal of the driving circuit; during a data writing phase in the display mode, the data signal input at the data and sensing line is written by the data writing circuit into the control terminal of the driving circuit under control of the first turn-on signal at the first control line; and during a light emitting phase in the display mode, the light emitting element is driven by the driving circuit to emit light under control of a voltage of the data signal.

According to an embodiment of the present disclosure, during the data output phase in the second sensing mode, the reference voltage provided at the voltage supply terminal is continuously input by the first initialization circuit to the control terminal of the driving circuit under control of the first turn-on signal at the first control line.

According to an embodiment of the present disclosure, during the data output phase in the first sensing mode, the first initialization circuit stops inputting the reference voltage provided at the voltage supply terminal to the control terminal of the driving circuit under control of a first turn-off signal at the first control line.

It should be illustrated that the foregoing explanation and description of the embodiment of the pixel driving circuit are also applicable to the method of driving a pixel driving circuit according to the present embodiment, and will not be repeated here.

With the method of driving a pixel driving circuit according to the embodiments of the present disclosure, the data line and the sensing line are combined, so that a number of channels of the data driving circuit chip may be reduced while ensuring the accuracy of the acquired external compensation value, which is beneficial to improve the physical resolution of the panel while improving the speed at which compensation is performed. In addition, the method of driving a pixel driving circuit according to the embodiments of the present disclosure also has advantages of simple driving waveforms.

The embodiments of the present disclosure further provide a display panel, comprising the pixel driving circuit according to the embodiments described above.

Figure 6:
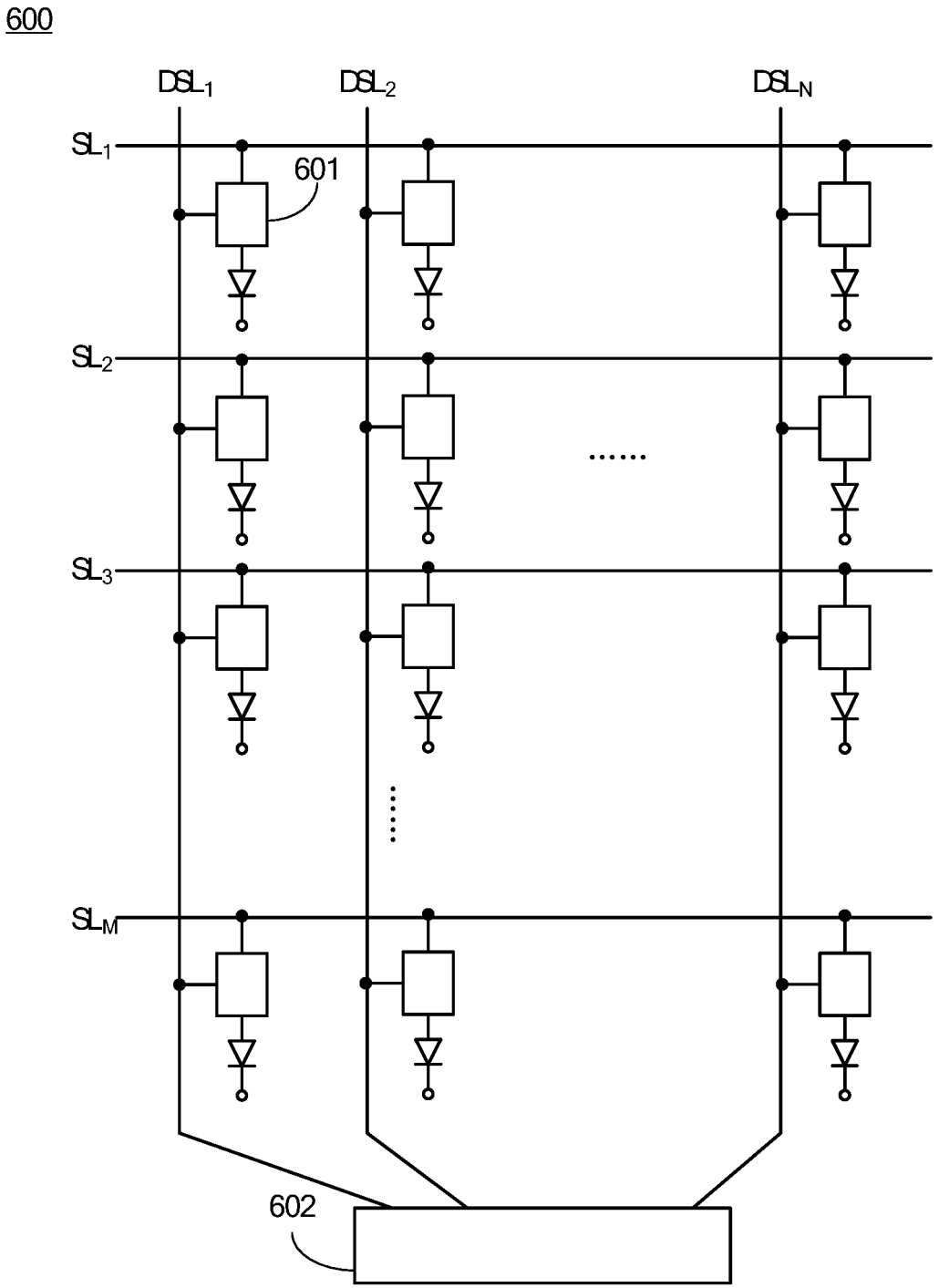
FIG. 6 is a schematic block diagram of a display panel according to an embodiment of the present disclosure.

FIG. 6 is a schematic block diagram of a display panel according to an embodiment of the present disclosure. As shown in FIG. 6, the display panel 600 according to the embodiment of the present disclosure comprises pixel driving circuits 601 and a data driving circuit 602.

In FIG. 6, $SL_1$, $SL_2$, $SL_3$, . . . , $SL_M$ represent scan lines, and each of $SL_1$, $SL_2$, $SL_3$, . . . , $SL_M$ may comprise a first control line G1, a second control line G2, and a third control line G3. $DSL_1$, $DSL_2$, . . . , $DSL_N$ represent data and sensing lines. The pixel driving circuits 601 may be arranged in directions of the scan lines and the data and sensing lines to form an array of pixel units. The pixel driving circuits 601 may have the structure of the pixel driving circuit described above with reference to FIG. 1 or FIG. 2 and will not be repeated here. The data driving circuit 602 is coupled to the data and sensing lines $DSL_1$, $DSL_2$, . . . , $DSL_N$. The data driving circuit 602 may acquire sensing signals output from the data and sensing lines, compensate for data signals based on the sensing signals, and provides compensated data signals to the data and sensing lines.

With the display panel according to the embodiment of the present disclosure, a number of channels of the data driving circuit chip may be reduced while ensuring the accuracy of the acquired external compensation value, which is beneficial to improve the physical resolution of the panel while improving the speed at which compensation is performed.

The embodiments of the present disclosure further provide a display apparatus, comprising the display panel according to the embodiments described above.

Figure 7:
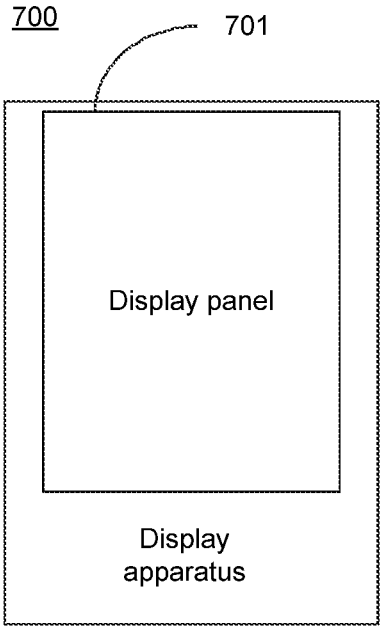
FIG. 7 is a schematic block diagram of a display apparatus according to an embodiment of the present disclosure.

FIG. 7 is a schematic block diagram of a display apparatus according to an embodiment of the present disclosure. As shown in FIG. 7, the display apparatus 700 according to the embodiment of the present disclosure comprises a display panel 701. The display panel 701 may have the structure of the display panel 600 in the embodiment described above, and will not be repeated here. The display apparatus 700 according to the embodiment of the present disclosure may be any product or component having a display function such as an electronic paper, a mobile phone, a tablet computer, a television, a display, a notebook computer, a digital photo frame, a navigator, etc.

With the display apparatus according to the embodiment of the present disclosure, the data line and the sensing line are combined, so that a number of channels of the data driving circuit chip may be reduced while ensuring the accuracy of the acquired external compensation value, which is beneficial to improve the physical resolution of the panel while improving the speed at which compensation is performed. In addition, the display apparatus according to the embodiment of the present disclosure also has advantages of simple driving waveforms and easy gate driving integration.

Although the embodiments of the present disclosure have been illustrated and described above, it may be understood that the above-mentioned embodiments are exemplary and may not be construed as limitations to the present disclosure. Those of ordinary skill in the art may make changes, modifications, substitutions and variations to the embodiments described above within the scope of the present disclosure.

What is claimed is:

1. A pixel driving circuit, comprising:

a driving circuit having a control terminal, a first terminal coupled to a first power supply and a second terminal coupled to a light emitting element, and configured to generate a driving current for driving the light emitting element under control of a potential at the control terminal of the driving circuit;

an energy storage circuit having a first terminal coupled to the control terminal of the driving circuit, and a second terminal coupled to the second terminal of the driving circuit;

a data and sensing line configured to input a data signal or output a sensing signal;

a first initialization circuit coupled to a voltage supply terminal, the control terminal of the driving circuit and a first control line, and configured to provide a potential at the voltage supply terminal to the control terminal of the driving circuit under control of a potential at the first control line during a sensing initialization phase of a sensing mode;

a second initialization circuit coupled to the data and sensing line, the second terminal of the driving circuit and a second control line, and configured to provide a potential at the second terminal of the driving circuit as the sensing signal to the data and sensing line under control of a potential at the second control line during a data output phase of the sensing mode; and a data writing circuit coupled to the data and sensing line, the control terminal of the driving circuit and a third control line, and configured to provide a data signal input at the data and sensing line to the control terminal of the driving circuit under control of a potential at the third control line in a display mode.

2. The pixel driving circuit according to claim 1, wherein the first initialization circuit comprises:

a first transistor having a first electrode coupled to the voltage supply terminal, a second electrode coupled to the control terminal of the driving circuit, and a control electrode coupled to the first control line.

3. The pixel driving circuit according to claim 1, wherein the second initialization circuit comprises:

a second transistor having a first electrode coupled to the data and sensing line, a second electrode coupled to the second terminal of the driving circuit, and a control electrode coupled to the second control line.

4. The pixel driving circuit according to claim 1, wherein the data writing circuit comprises:

a third transistor having a first electrode coupled to the data and sensing line, a second electrode coupled to the control terminal of the driving circuit, and a control electrode coupled to the third control line.

5. The pixel driving circuit according to claim 1, wherein the driving circuit comprises a driving transistor having a first electrode coupled to the first power supply to act as the first terminal of the driving circuit, a second electrode coupled to the light emitting element to act as the second terminal of the driving circuit, and a control electrode coupled to the energy storage circuit, the first initialization circuit and the data writing circuit to act as the control terminal of the driving circuit; and the energy storage circuit comprises a first capacitor having a first electrode coupled to the control electrode of the driving transistor to act as the first terminal of the energy storage circuit, and a second electrode coupled to the second electrode of the driving transistor to act as the second terminal of the energy storage circuit.

6. The pixel driving circuit according to claim 1, further comprising a second capacitor having a first electrode coupled to the data and sensing line, and a second electrode coupled to a second power supply.

7. A display panel comprising the pixel driving circuit according to claim 1.

8. The display panel according to claim 7, further comprising a data driving circuit coupled to the data and sensing line of the pixel driving circuit, and configured to acquire the sensing signal output by the data and sensing line, compensate for the data signal based on the sensing signal, and provide a compensated data signal to the data and sensing line.

9. A display apparatus comprising the display panel according to claim 8.

10. A method of driving a pixel driving circuit, the pixel driving circuit comprising:

a driving circuit having a control terminal, a first terminal coupled to a first power supply and a second terminal coupled to a light emitting element, and configured to generate a driving current for driving the light emitting element under control of a potential at the control terminal of the driving circuit;

an energy storage circuit having a first terminal coupled to the control terminal of the driving circuit, and a second terminal coupled to the second terminal of the driving circuit;

a data and sensing line configured to input a data signal or output a sensing signal;

a first initialization circuit coupled to a voltage supply terminal, the control terminal of the driving circuit and a first control line, and configured to provide a potential at the voltage supply terminal to the control terminal of the driving circuit under control of a potential at the first control line;

a second initialization circuit coupled to the data and sensing line, the second terminal of the driving circuit and a second control line, and configured to provide a potential at the second terminal of the driving circuit as the sensing signal to the data and sensing line under control of a potential at the second control line; and a data writing circuit coupled to the data and sensing line, the control terminal of the driving circuit and a third control line, and configured to provide a data signal input at the data and sensing line to the control terminal of the driving circuit under control of a potential at the third control line; and the driving method comprising:

in a display mode, writing, by the data writing circuit, the data signal input at the data and sensing line into the control terminal of the driving circuit under control of the potential at the third control line, and generating, by the driving circuit, the driving current for driving the light emitting element under control of the potential at the control terminal of the driving circuit; and in a sensing mode, providing, by the second initialization circuit, the potential at the second terminal of the driving circuit to the data and sensing line to be output as the sensing signal under control of the potential at the second control line, wherein in the sensing mode, during a sensing initialization phase, inputting, by the first initialization circuit, a reference voltage provided at the voltage supply terminal to the control terminal of the driving circuit under control of the potential at the third control line; and during a data output phase, generating, by the driving circuit, a sensing voltage at the second terminal of the driving circuit under control of the reference voltage and the first power supply, and providing, by the second initialization circuit, the sensing voltage generated at the second terminal of the driving circuit to the data and sensing line to be output as the sensing signal under control of the potential at the second control line.

11. The method according to claim 10, wherein in the display mode, during a display initialization phase, providing, by the first initialization circuit, a first initialization voltage provided at the voltage supply terminal to the control terminal of the driving circuit under control of the potential at the third control line to initialize the control terminal of the driving circuit, and providing, by the second initialization circuit, a second initialization voltage provided at the data and sensing line to the second terminal of the driving circuit under control of the potential at the second control line to initialize the second terminal of the driving circuit;

during a data writing phase, writing, by the data writing circuit, the data signal input at the data and sensing line into the control terminal of the driving circuit under control of the potential at the first control line; and during a light emitting phase, driving, by the driving circuit, the light emitting element to emit light under control of the data signal.

12. The method according to claim 10, wherein the sensing mode comprises a first sensing mode and a second sensing mode, wherein an operation in the first sensing mode is performed during a blanking period of a display cycle of one frame of screen; and an operation in the second sensing mode is performed during a period in which display of the screen is disabled.

13. The method according to claim 12, wherein in the second sensing mode, during the data output phase, continuously inputting, by the first initialization circuit, the reference voltage provided at the voltage supply terminal to the control terminal of the driving circuit under control of the potential at the first control line.

14. The method according to claim 12, wherein in the first sensing mode, during the data output phase, stopping, by the first initialization circuit, inputting the reference voltage provided at the voltage supply terminal to the control terminal of the driving circuit under control of the potential at the first control line.

* * * * *